US006923018B1

(12) United States Patent
Pfister et al.

(10) Patent No.: US 6,923,018 B1
(45) **Date of Patent: *Aug. 2, 2005**

(54) ELECTRO-DESORPTION ACTUATOR

(75) Inventors: Dennis M. Pfister, San Luis Obispo, CA (US); Charles M. Byrd, Rensselaer, NY (US); Howard L. Davidson, San Carlos, CA (US); Charles J. Ingalz, San Jose, CA (US)

(73) Assignee: Sun Microsystems, Inc., Santa Clara, CA (US)

( * ) Notice: Subject to any disclaimer, the term of this patent is extended or adjusted under 35 U.S.C. 154(b) by 16 days.

This patent is subject to a terminal disclaimer.

(21) Appl. No.: 10/611,568

(22) Filed: Jun. 30, 2003

Related U.S. Application Data

(63) Continuation-in-part of application No. 10/241,199, filed on Sep. 11, 2002, now Pat. No. 6,662,591, which is a continuation of application No. 09/834,080, filed on Apr. 12, 2001, now Pat. No. 6,502,419.

(51) Int. Cl.[7] ..... F25B 33/00; F25B 15/00
(52) U.S. Cl. ..... 62/497; 62/480; 62/128
(58) Field of Search ..... 62/497, 480, 148, 62/481, 476

(56) References Cited

U.S. PATENT DOCUMENTS 4,581,049 A * 4/1986 Januschkowetz ..... 96/126
5,567,284 A 10/1996 Bauer et al.
5,855,119 A * 1/1999 Pfister et al. ..... 62/259.2
6,502,419 B2 * 1/2003 Pfister et al. ..... 62/497

* cited by examiner

*Primary Examiner*—Chen Wen Jiang
(74) *Attorney, Agent, or Firm*—Gunnison, McKay & Hodgson, L.L.P.

(57) ABSTRACT

An electro-desorption actuator comprises a fixed member, a movable member which is coupled to the fixed member, a pressure chamber which is disposed between the fixed member and the movable member, and a sorption compression system which is in communication with the pressure chamber. The sorption compression system comprises first and second electrical conductors, a sorbent which is positioned between the first and second conductors, a sorbate which is capable of combining with the sorbent in an adsorption reaction to form a sorbate/sorbent compound, and a power supply which is connected to the conductors and which is selectively actuated to generate a current that is conducted through the sorbate/sorbent compound to desorb the sorbate from the sorbent in a desorption reaction. The sorbate is communicated from the sorption compression system to the pressure chamber during the desorption reaction and from the pressure chamber back to the sorption compression system during the adsorption reaction. Thus, during the desorption reaction a relatively high pressure is created in the pressure chamber which will displace the movable member in one direction, and during the adsorption reaction a relatively low pressure is created in the pressure chamber which will displace the movable member in the opposite direction.

42 Claims, 6 Drawing Sheets

Fig. 4
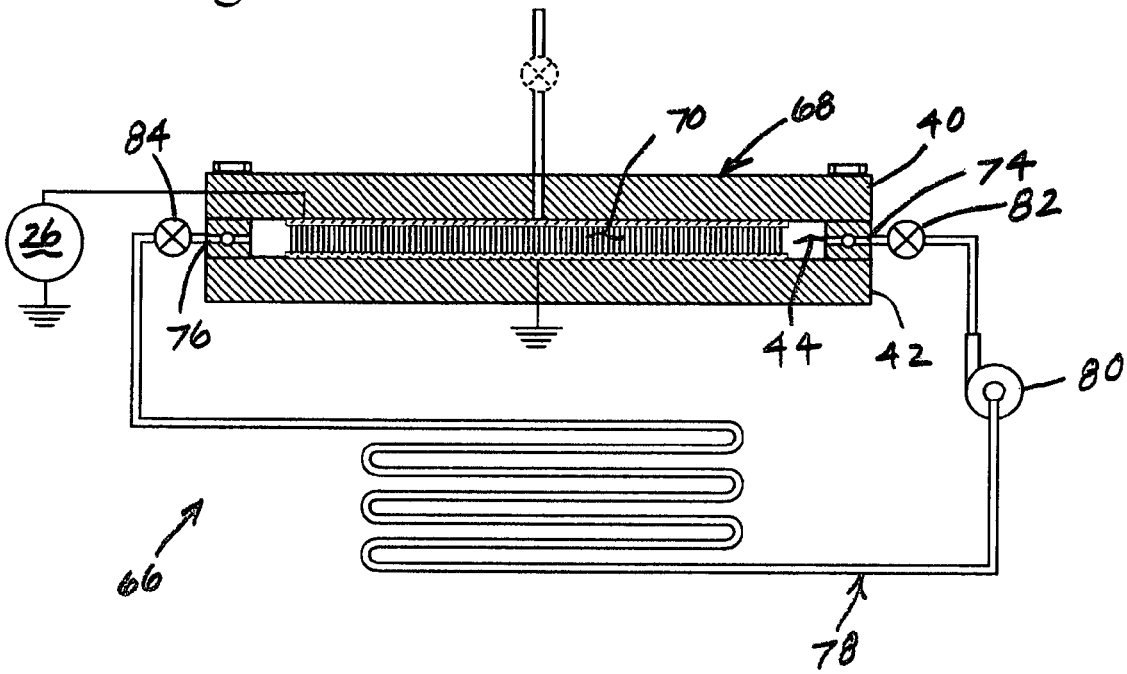
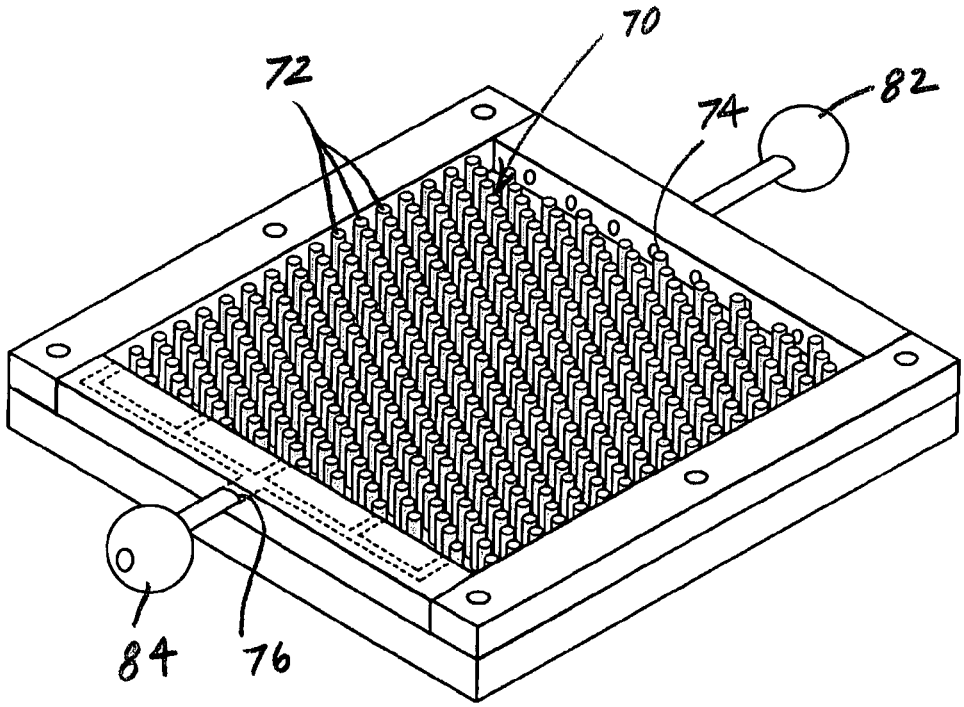
Fig. 5

Fig. 6
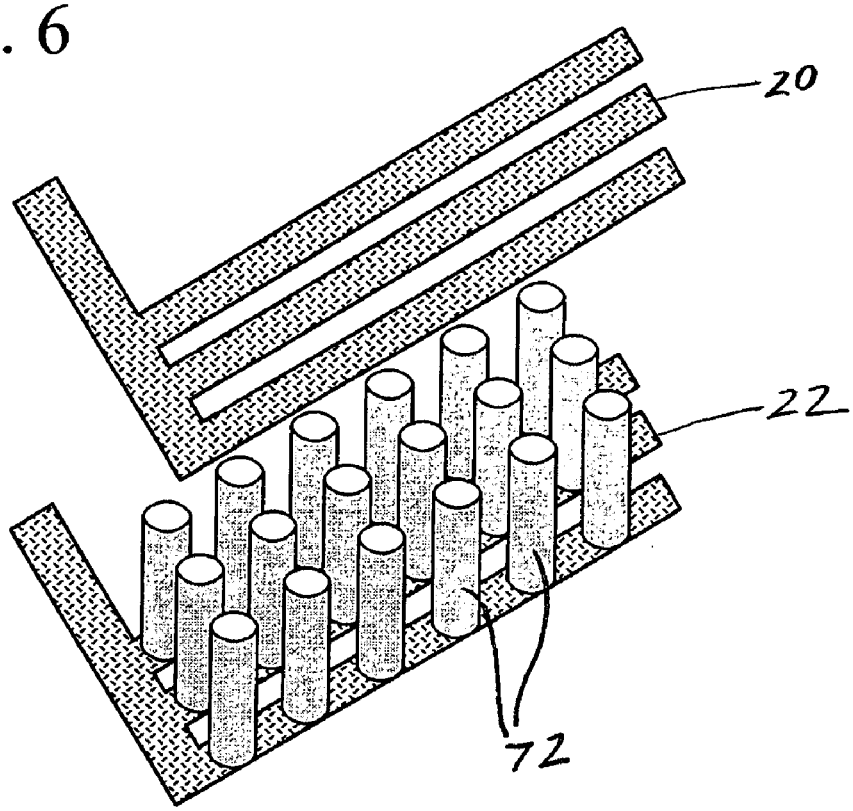
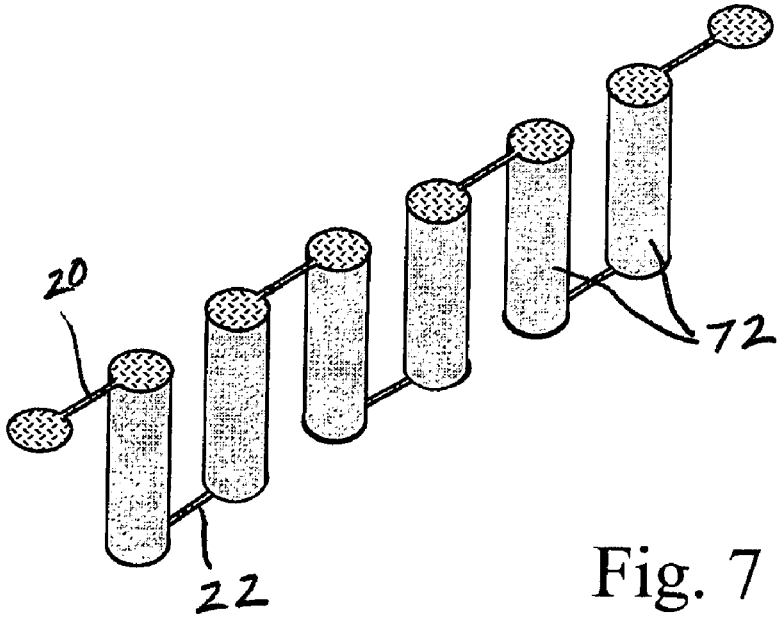
Fig. 7

Fig. 10
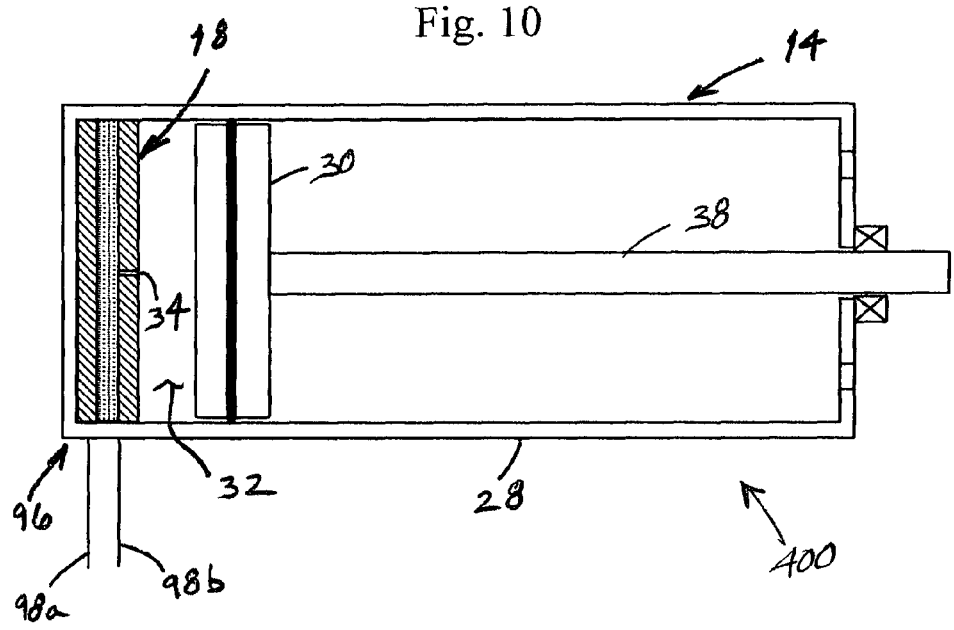
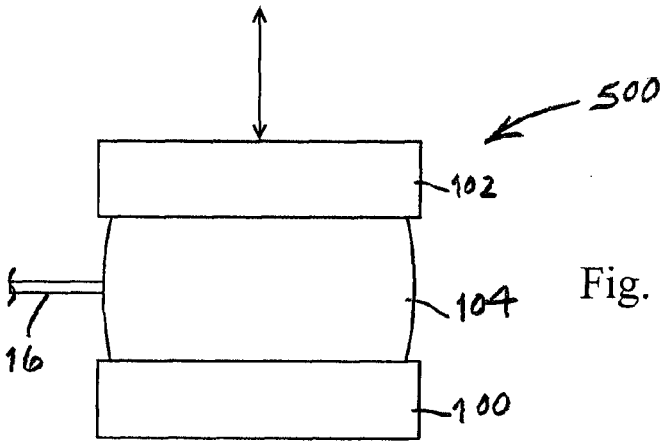
Fig. 11
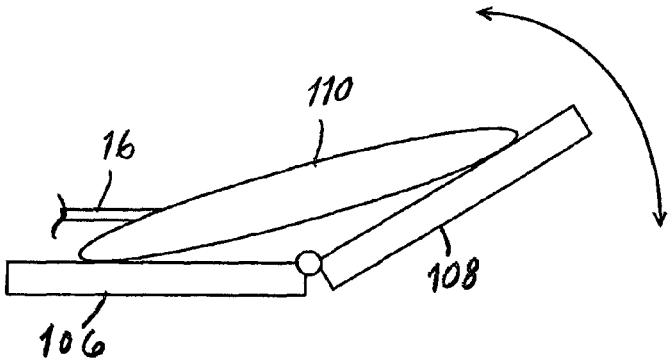
Fig. 12

ELECTRO-DESORPTION ACTUATOR

This is a continuation-in-part of U.S. patent application Ser. No. 10/241,199 filed on Sep. 11, 2002 now U.S. Pat. No. 6,662,591, which is a continuation of U.S. patent application Ser. No. 09/834,080 filed on Apr. 12, 2001, now U.S. Pat. No. 6,502,419, both of which are hereby incorporated herein by reference.

BACKGROUND OF THE INVENTION

The present invention relates to a mechanical actuator which is driven by an actuating pressure that is generated by a closed-cycle adsorption compression system which employs electrical energy to desorb a sorbate from a sorbent in a substantially non-thermal reaction.

Typical actuators comprise a fixed member which is coupled to a movable member and means for selectively displacing the movable member relative to the fixed member. In hydraulic or pneumatic actuators, the means for displacing the movable member relative to the fixed member generally comprises an actuating pressure which is communicated to a pressure chamber that is defined between the fixed member and the movable member. For example, existing hydraulic cylinders usually comprise a piston which is slidably disposed within a fixed cylinder and which is displaced relative to the cylinder by pressurized hydraulic fluid that is applied between the piston and the cylinder. The motion of the piston may be transferred via a mechanical or magnetic linkage to any device whose operation requires such movement.

Typical hydraulic and pneumatic actuators require a pump or compressor to create the actuating pressure and suitable conduits and valves to convey the actuating pressure to the piston. The pumps and compressors for these actuators include moving parts that create undesired noise and vibrations. In addition, a possibility exists that the conduits and valves may leak, which could result in failure of the actuator.

SUMMARY OF THE INVENTION

Instead of using pumps or compressors to create the actuating pressure for the movable member, the electro-desorption actuator of the present invention employs an adsorption compression system for this purpose. In existing adsorption and absorption compression systems, which will be referred to herein simply as sorption compression systems, a first, typically gaseous substance called a sorbate is alternately adsorbed (or absorbed) onto and desorbed from a second, typically solid substance called a sorbent. Particular sorption compression systems utilize specific sorbates and sorbents to produce a desired effect which is dependent on the affinity of the two substances. During the adsorption reaction, the relatively low pressure sorbate is drawn onto and combines with the sorbent to produce a sorbate/sorbent compound. During the desorption reaction, energy is supplied to the sorbate/sorbent compound to break the bonds between the sorbate and sorbent molecules and thereby desorb the sorbate from the sorbent. In this reaction, the sorbate molecules are driven off of the sorbent molecules and into a relatively high pressure, high energy gaseous state. Substantial energy is imparted to the sorbate during the desorption reaction, and this energy can be harnessed for various uses.

In accordance with the present invention, therefore, an electro-desorption actuator is provided which comprises a fixed member, a movable member which is coupled to the fixed member, a pressure chamber which is disposed between the fixed member and the movable member and sorption compression system which is in communication with the pressure chamber. The sorption compression system of one embodiment of the invention comprises first and second electrical conductors, a sorbent which is positioned between the first and second conductors, a sorbate which is capable of combining with the sorbent in an adsorption reaction to form a sorbate/sorbent compound, and a power supply which is connected to the conductors and which is selectively actuated to generate a current that is conducted through the sorbate/sorbent compound to desorb the sorbate from the sorbent in a desorption reaction.

In one embodiment of the invention, the sorption compression system is positioned adjacent the pressure chamber. Thus, the actuator does not require any independent conduits to communicate the sorbate to and from the pressure chamber.

In operation of the electro-desorption actuator of the present invention, the sorbate is communicated from the sorption compression system to the pressure chamber during the desorption reaction and from the pressure chamber back to the sorption compression system during the adsorption reaction. Thus, during the desorption reaction a relatively high pressure is created in the pressure chamber which will displace the movable member in one direction, and during the adsorption reaction a relatively low pressure is created in the pressure chamber which will displace the movable member in the opposite direction. In addition, the adsorption and desorption reactions may be repeated to cycle the sorbate into and out of the pressure chamber and thereby repeatedly displace the movable member back and forth relative to the fixed member.

Thus, it may be seen that the actuating pressure of the electro-desorption actuator of the present invention is generated by a sorption compression system that does not comprise any moving parts. Consequently, the sorption compression system will not produce any undesired noise or vibrations. In addition, when the sorption compression system is positioned adjacent the pressure chamber, the actuator does not require any independent conduits to communicate the actuating pressure to the pressure chamber, and these potential leak paths are therefore eliminated.

These and other objects and advantages of the present invention will be made apparent from the following detailed description, with reference to the accompanying drawings. In the drawings, the same reference numbers are used to denote similar elements in the various embodiments.

BRIEF DESCRIPTION OF THE DRAWINGS

FIG. 4 is a diagrammatic representation of an alternative sorption compression system for the actuator of the present invention;

FIG. 5 is a perspective view of a portion of the sorber component of the sorption compression system shown in FIG. 4;

FIG. 6 is a partial, exploded view of the sorbent and conductor components of the sorption compression system shown in FIG. 4;

FIG. 7 is a partial view of an alternative arrangement of the sorbent and conductor components of the sorption compression system shown in FIG. 4;

FIG. 10 is a cross-sectional view of another embodiment of an actuator according to the present invention;

FIG. 11 is a schematic representation of a portion of yet another embodiment of an actuator according to the present invention; and FIG. 12 is a schematic representation of a portion of still another embodiment of an actuator according to the present invention.

DETAILED DESCRIPTION OF THE PREFERRED EMBODIMENTS

The electro-desorption actuator of the present invention comprises a sorption compression system to selectively cycle a sorbate between a low pressure state and a high pressure state to thereby displace a movable member back and forth relative to a fixed member. The sorption compression system cycles the sorbate between the low pressure state and the high pressure state by repeatedly adsorbing the sorbate onto a sorbent and then desorbing the sorbate from the resulting sorbate/sorbent compound. While the present invention contemplates that the sorption compression system could employ heat or electromagnetic waves to desorb the sorbate from the sorbate/sorbent compound, in the preferred embodiment of the invention the sorption compression system utilizes an electrical current to desorb the sorbate from the sorbate/sorbent compound. In addition, the sorbate and sorbent are ideally selected and the desorption reaction is optimally controlled so that the current will not appreciably heat the sorbate/sorbent compound during the desorption reaction. Consequently, the desorption of the sorbate from the sorbate/sorbent compound is preferably substantially non-thermal, and this greatly improves the efficiency of the actuator.

Figure 1:
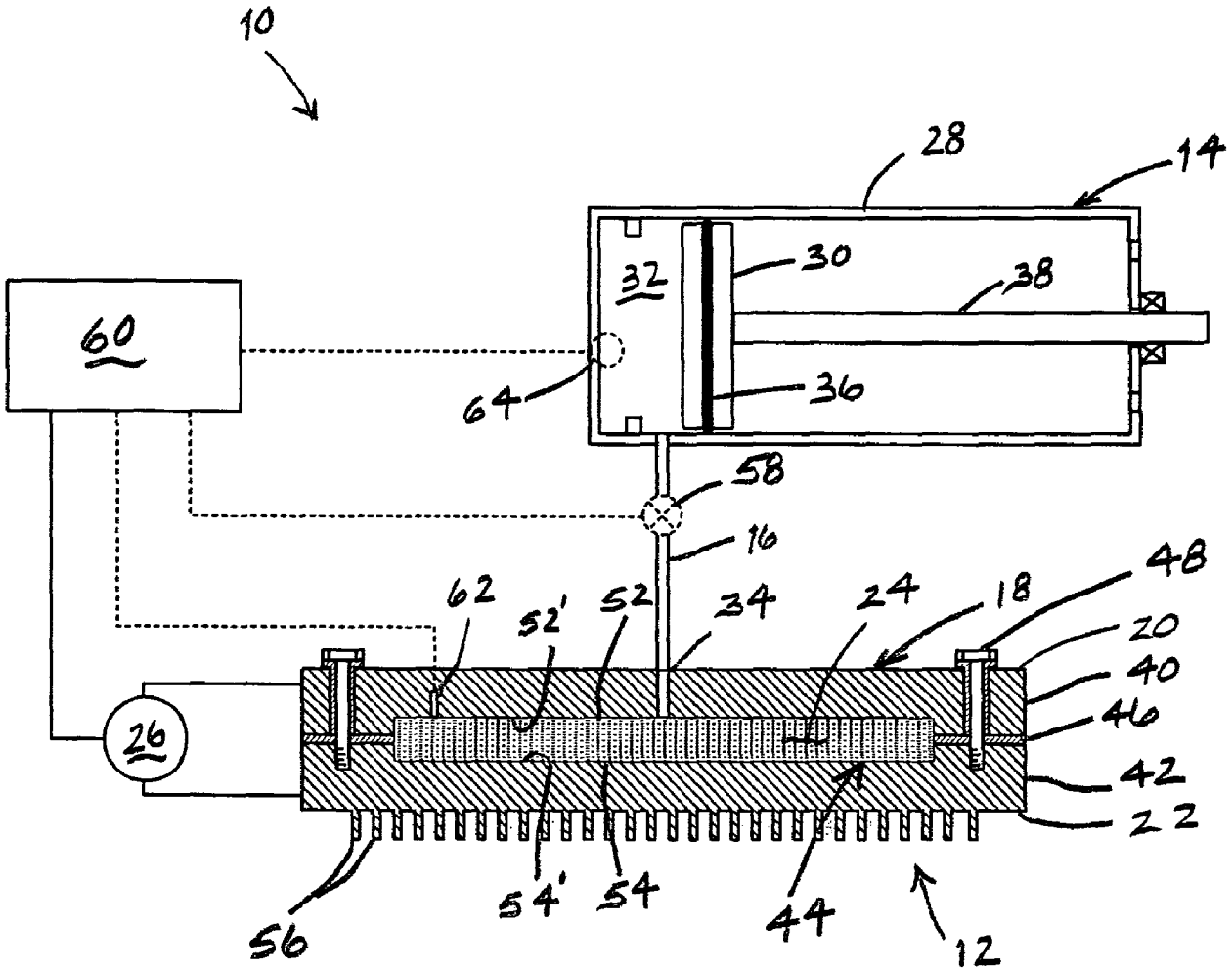
FIG. 1 is a diagrammatic, partial cross-sectional representation of the actuator of the present invention.
Figure 2:
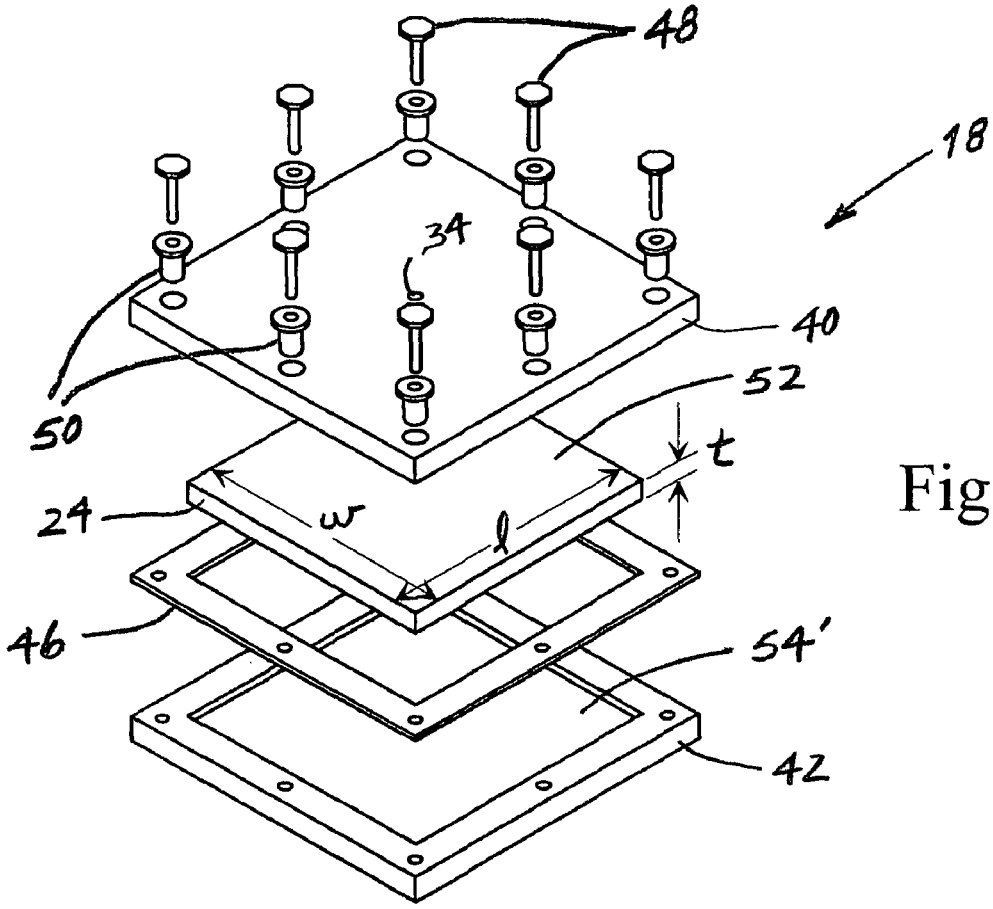
FIG. 2 is an exploded view of the sorber component of the sorption compression system of the actuator depicted in FIG. 1.

Referring to FIGS. 1 and 2, the electro-desorption actuator of the present invention, which is indicated generally by reference number 10, is shown to comprise a sorption compression system 12 which is connected to an actuator housing 14 by a suitable conduit 16. The sorption compression system 12 comprises a sorber 18 which includes spaced apart first and second conductors 20, 22, a sorbate/sorbent compound 24 which is contained within the sorber 18 between the first and second conductors, and a power supply 26 which is connected to the first and second conductors by suitable wires.

In the embodiment of the invention shown in FIG. 1, the actuator housing 14 defines a cylinder 28 within which a piston 30 is slidably received. Thus, in this embodiment of the invention the cylinder 28 comprises the fixed member and the piston 30 comprises the movable member of the actuator 10. The piston 30 and one end of the cylinder 28 enclose a pressure chamber 32 which is in fluid communication with the sorbate/sorbent compound 24 via the conduit 16 and an inlet/outlet port 34 in the sorber. As is conventional with cylinder-type actuators, a suitable seal 36 is positioned between the piston 30 and the cylinder 28 to maintain the pressure chamber 32 pressure tight. In addition, a push rod 38 is connected to the piston to transfer the motion of the piston to an external device (not shown) to which the actuator is connected.

In operation of the electro-desorption actuator 10, during each desorption reaction, which will be described more fully hereafter, an electrical current from the power supply 26 is conducted by the first and second conductors 20, 22 across the sorbate/sorbent compound 24 to desorb the sorbate from the sorbent. The electrical current liberates the sorbate molecules from the sorbent molecules, and the resulting high pressure, high energy sorbate expands through the inlet/outlet port 34 into the pressure chamber 32 and forces the piston 30 to displace to the right within the cylinder 28 (as viewed in FIG. 1). During each adsorption reaction, the sorbate in the pressure chamber 32 is communicated through the inlet/outlet port 34 back into the sorber 18 and re-adsorbed onto the sorbent to form the sorbate/sorbent compound 24. As the sorbate is drawn back into the sorber 18, a negative pressure is created in the pressure chamber 32 which pulls the piston 30 back to its original position. This movement of the piston is transferred to the external device by the push rod 38.

Since the sorber 18 is the enclosure within which the desorption and adsorption reactions take place, the sorber must function to contain the sorbate/sorbent compound 24, conduct the current from the power supply 26 to the sorbate/sorbent compound, and provide for communication of the sorbate to and from the sorbent. Numerous devices having various structural and electrical configurations may be conceived to perform these functions. By way of example, the sorber 18 depicted in FIGS. 1 and 2 is shown to comprise a recessed top plate 40 which is attached to a recessed bottom plate 42 to form an enclosure 44 for the sorbate/sorbent compound 24. In this embodiment of the sorber 18, the top plate 40 forms the first conductor 20 and the bottom plate 42 forms the second conductor 22. Accordingly, the top and bottom plates 40, 42 are made of a suitable electrically conductive material, such as an Aluminum alloy. In addition, the top and bottom plates 40, 42 are electrically insulated from each other, for example, by positioning a gasket 46 of an appropriate electrically insulating, chemically inert and heat resistant material, such as synthetic rubber, between them. The gasket 46 also provide a pressure-tight seal between the top and bottom plates 40, 42, although other means, such as a conventional O-ring, may be provided for this purpose. The sorbate is communicated into and out of the enclosure 44 via the inlet/outlet port 34, which is formed in either the top plate 40 or the bottom plate 42. Of course, any number of separate inlet and outlet ports may be provided for this purpose.

Figure 3:
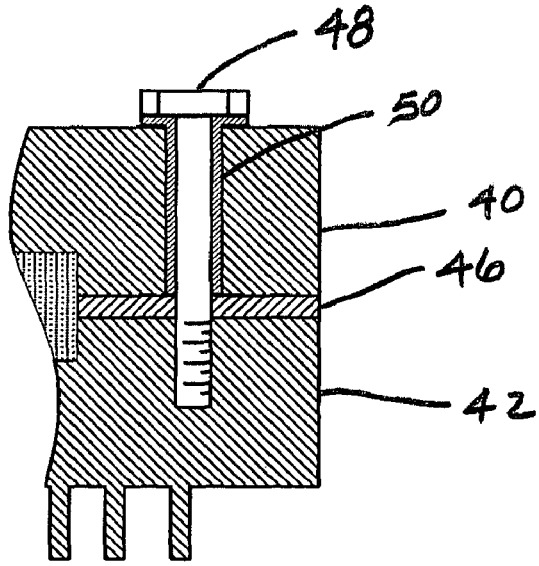
FIG. 3 is an enlarged cross-sectional view of a portion of the sorber component of the sorption compression system shown in FIG. 1.

Furthermore, the top and bottom plates 40, 42 are secured together with a number of suitable fasteners 48, such as high strength steel bolts. Also, as shown most clearly in FIG. 3, an insulating grommet 50, which is made of a suitable electrically insulating and heat resistant material, such as Teflon®, is positioned between each bolt 48 and the top plate 40 to electrically insulate the bolt, and thus the bottom plate 42, from the top plate.

In the embodiment of the invention depicted in FIGS. 1 and 2, the sorber 18 also functions to help dissipate the heat of adsorption from the sorbate/sorbent compound 24. Thus, in addition to being electrically conductive, the top and bottom plates 40, 42 are preferably constructed of a material having a good thermal conductivity. In addition, if as shown in FIGS. 1 and 2 the sorbent comprises relatively large top and bottom surfaces 52 and 54, respectively, compared to its thickness "t", the top and bottom plates 40, 42 preferably each include a respective inner surface 52', 54' which engages substantially the entire corresponding top or bottom surface 52, 54. In this manner, the thermal diffusion path length for the sorbate/sorbent compound 24 will be minimized (in effect one-half the thickness "t"), and the rate of heat transfer from the sorbate/sorbent compound will consequently be maximized. In addition, the top plate 40 or the bottom plate 42, or both, may be provided with cooling fins 56 to assist in the dissipation of the heat of adsorption from the sorbate/sorbent compound 24.

The transfer of thermal and electrical energy through the junction between the sorbate/sorbent compound 24 and the sorber 18 is preferably optimized by enhancing the contact between the sorbent and the top and bottom plates 40, 42. Depending on the type of sorbent employed in the sorption compression system 12, this may be accomplished by soldering or brazing the sorbent to the top and/or bottom plates 40, 42. Alternatively, the sorbent may be affixed to the top and/or bottom plates 40, 42 using a suitable thermally and electrically conductive adhesive. Where brazing, soldering or gluing are not appropriate, the sorbent and the sorber 18 may be designed with a slight interference fit to produce a suitable contact pressure between the sorbent and the top and bottom plates 40, 42. The contact between the sorbent and the sorber 18 may also be enhanced by positioning a foil of soft metal, such as indium, between the sorbent and each of the top and bottom plates 42, 44.

While the present invention contemplates that the sorber 18 could be incorporated in to the actuator housing 14, in the event the sorber is physically removed from the actuator housing, as in the embodiment of the invention shown in FIG. 1, the sorption compression system 12 includes the conduit 16 to connect the inlet/outlet port 34 with the pressure chamber 32. In addition, a valve 58 may be provided in the conduit 16 for controlling the flow of sorbate into and out of the sorber 18. The valve 58 may be manually operable; however, to facilitate the automatic operation of the sorption compression system, the valve is preferably an electrically actuated solenoid-type valve. Alternatively, in the event the sorber 18 comprises separate inlet and outlet ports instead of a single inlet/outlet port 34, an appropriately oriented check valve may be connected between each port and a corresponding conduit 16 to control the flow of sorbate into and out of the sorber 18.

The selection of the particular sorbate and sorbent materials for the sorption compression system 12 depends on the desired nature of the desorption reaction. In accordance with one embodiment of the invention, the sorbate and sorbent material are selected such that, when the electrical current is conducted through the sorbate/sorbent compound to effect the desorption reaction, the sorbate/sorbent compound is not heated appreciably. Thus, the desorption reaction is substantially non-thermal. In the context of the present invention, "non-thermal desorption" refers to a mechanism of desorption that does not rely on thermal energy to stochastically heat the sorbate/sorbent compound to the degree sufficient to break the bonds between the sorbate and sorbent molecules. Thus, while some isolated, localized heating of the sorbate/sorbent compound may occur during the desorption reaction, the temperature of the sorbate/sorbent compound should remain statistically below the threshold temperature for thermal desorption to take place.

One method for determining whether a particular desorption reaction is either thermal or substantially non-thermal is to measure the bulk temperature of the sorbate/sorbent compound during the desorption cycle. If the bulk temperature of the compound during the desorption reaction is greater than the known temperature which is required to effect a thermal or heat-activated desorption, then the reaction is thermal. However, if the bulk temperature of the sorbate/sorbent compound during the desorption reaction is less than the temperature required to effect the thermal desorption, the reaction may or may not be thermal. In this event, the velocity distribution of the desorbed sorbate molecules may be analyzed to determine whether the desorption reaction is substantially non-thermal. The molecular velocity distribution can be determined by, for example, using time-of-flight spectroscopy to produce a time-resolved distribution of the florescence intensities of a characteristic molecular beam. Then, using a Fourier transform, the molecular velocity distribution can be extracted from the florescence data. Since it is known that in a non-thermal process the velocity distribution of the desorbed sorbate molecules should be primarily non-Maxwellian, by analyzing the time-of-flight spectroscopy data, the thermal/non-thermal nature of the desorption process can be determined.

The exact mechanism by which the electrical current effects the desorption of the sorbate molecules from the sorbent molecules varies depending on the type of sorbent employed. Moreover, while the exact mechanism is not known, the inventors believe that, when the current is conducted through the sorbate/sorbent compound, electrons are channeled into each sorbate—sorbent bond until the bond is broken and the sorbate molecule is liberated from the sorbent molecule. With respect to the carbon-based sorbents which will be discussed below, one theory is that the electrons from the power supply displace the electrons of the sorbate molecule in the conduction band of the sorbent molecule, thereby freeing the sorbate molecule from the sorbent molecule. Another theory is that the electrons impart sufficient energy to the sorbate molecule to allow it to escape the electrical potential binding it to its associated sorbent molecule.

In addition to the nature of the desorption reaction, the selection of the sorbate and sorbent materials depends on the requirements of the sorption compression system. In a sorption compression system which is used to drive the electro-desorption actuator of the present invention, the system may need to provide a particular pressure differential between the sorbate in its low pressure state and the sorbate in its high pressure state in order to produce a desired amount of work. Generally, the desired characteristics of a sorption compression system will suggest the use of a particular sorbate or sorbent material, and then the other material may be determined by examining the vapor pressure curves for various sorbate/sorbent compounds.

The sorbate and sorbent materials are preferably also selected based on the desired electrical and thermal conductivities of these materials. Since in one embodiment of the invention the desorption reaction is driven by an electric current, the sorbate/sorbent compound should be a good electrical conductor. In addition, in the event that the sorbate molecules bind only to the surface of the sorbent material during the adsorption reaction, the sorbent should also be a good electrical conductor. Moreover, if the power supply 26 is an AC power supply, the sorbate and sorbent materials should ideally be selected so that the combined impedance of the sorber 18 and the sorbate/sorbent compound 24 matches that of the power supply to ensure that the maximum amount of power is transferred from the power supply to the sorbate/sorbent compound. If on the other hand the power supply 26 is a DC power supply, the sorbate and sorbent materials should optimally be selected so that the combined resistance of the sorber 18 and the sorbate/sorbent compound is sufficiently large to avoid overloading the power supply.

Furthermore, Because the heat of adsorption must be dissipated from the sorbate/sorbent compound and the sorbent prior to the next adsorption reaction, both the sorbate/sorbent compound and the sorbent should be good thermal conductors. In a preferred embodiment of the invention, the sorbent comprises a thermal conductivity at least as great as that of aluminum or copper. It has been found that using a sorbent with such a thermal conductivity and a sorbate that meets the other requirements of the sorption compression system will result in a sorbate/sorbent compound that has a sufficient thermal conductivity for purposes of the present invention.

The sorbent should also comprise certain physical properties to enable it to be effectively utilized in the sorption compression system. For example, the sorbent is preferably sufficiently strong to withstand repeated adsorption and desorption reactions without fracturing or decomposing. In addition, the sorbent is ideally comprised of a material that can be soldered or brazed to the sorber to enhance the transfer of thermal and electrical energy through the junction between the sorbent and the sorber. Furthermore, the sorbent is optimally configured or constructed to comprise suitable mass transfer paths to facilitate the passage of a maximum amount of sorbate through the sorbent in a minimum amount of time during the adsorption and desorption reactions. Also, since the total amount of sorbate that can be adsorbed on a sorbent is proportional to the total surface area of the sorbent, the sorbent preferably comprises a relatively large surface area per unit volume of material.

Consistent with the above discussion, some preferred sorbent materials for use in the present invention include pitch-based carbon and graphitic foams, examples of which are disclosed in U.S. Pat. No. 5,961,814 and U.S. Pat. No. 6,033,506, which are hereby incorporated herein by reference. In order to improve the adsorption capacity of these foams, they may be activated using any suitable activation technique. Another suitable sorbent material for use in the present invention is applicants' proprietary pre-activated graphitic foam product, which is described in applicants' co-pending U.S. patent application Ser. No. 10/174,838, which is hereby incorporated herein by reference. Simple carbon and graphite pellets, granules, powders and fibers may also be used as the sorbent material in the present invention. These materials are preferably activated using a suitable activation method in order to improve their adsorption capacity. Also, any of the sorbent materials disclosed in applicants' U.S. patent application Ser. No. 09/834,080 may be used as the sorbent in the present invention. It should be understood that this list of possible sorbent materials is not complete, and that other materials which meet some or all of the above-listed requirements may also be suitable sorbents. The present invention should therefore not be limited by the particular sorbent materials listed above.

In the embodiment of the invention shown in FIGS. 1 and 2, the sorbent is formed into a monolithic member having a thickness "t" and generally parallel top and bottom surfaces 52, 54 which each have a length "l" and a width "w". Although the surfaces 52, 54 are depicted as being rectangular, they could have any practical shape. Since in this embodiment the top and bottom plates 40, 42 of the sorber 18 function to both conduct the electrical current across and dissipate the heat of adsorption from the sorbate/sorbent compound 24, the electrical conduction and thermal diffusion paths are both aligned in the direction of the thickness "t" of the sorbent. As mentioned above, in order to maximize the amount of power which is transferred to the sorbate/sorbent compound from an AC power supply, the combined impedance of the sorber 18 and the sorbate/sorbent compound 24 should match that of the power supply. Thus, for given sorbate and sorbent materials, the thickness "t" of the sorbent may be increased or decreased to adjust the impedance accordingly.

In addition, in order to minimize the thermal diffusion path length, the thickness "t" of the sorbent should be kept as small as possible. In the event the heat of adsorption is dissipated through both the top and bottom surfaces 52, 54, the thickness "t" is preferably less than the smallest linear dimension of the top or bottom surface, which, for example, is the length of the minor side of a rectangle, the length of any side of a square, or the length of the diameter of a circle. If the heat of adsorption is dissipated through only one of the top and bottom surfaces 52, 54, the thickness "t" is preferably less than one-half the smallest linear dimension of the top or bottom surface. More preferably, the thickness "t" is less than one-tenth the smallest linear dimension of the top or bottom surface. By sizing the sorbent accordingly, the minimum thermal diffusion path length will be transverse to the top and bottom surfaces, and the heat of adsorption will consequently be readily dissipated through either or both of these surfaces.

As discussed above, the sorbate which is employed in the sorption compression system 12 depends largely on the purpose of the system and the particular sorbent chosen for the system. The inventors have discovered that suitable sorbates for use with the carbon and graphitic foam sorbents discussed above are R134, Ammonia, Carbon Dioxide, Nitrous Oxide, Nitrogen, Krypton, Hydrogen and Methane, among others. These sorbates are readily desorbed by an electrical current, form a sorbate/sorbent compound that will not heat appreciably during the desorption reaction, and are capable of being cycled between a low pressure state and a high pressure state by being repeatedly adsorbed onto and desorbed from the sorbent.

The sorbate/sorbent compound is preferably carefully prepared prior to operation of the sorption compression system 12. Referring again to FIG. 1, a predetermined amount of sorbent is sealed within the enclosure 44 of the sorber 18 and the inlet/outlet port 34 is connected to a vacuum source (not shown). With a vacuum applied to the enclosure 44, an electrical current is conducted through the sorbent to drive off any water molecules or other contaminants that may be present in the sorbent. During this preparation step, the current may result in the sorbent being resistively heated, depending on the amount of contaminants that are present in the sorbent and the type of sorbent that is used. If so, then it is desired that the sorbent be heated to about 200° C. to ensure that the contaminants are sufficiently separated from the sorbent. This step is desirable to ensure that no contaminants are present that may interfere with the adsorption of the sorbate onto the sorbent or result in the sorbate/sorbent compound being resistively heated by the current during operation of the sorption compression system. After the contaminants are separated from the sorbent, they are drawn out of the sorber 18 by the vacuum. With the vacuum source removed, but with vacuum pressure maintained within the enclosure 44, the sorber is allowed to cool to ambient temperature, after which a predetermined amount of sorbate is introduced into the enclosure, for example via the inlet/outlet port 34, and allowed to adsorb onto the sorbent. At this point, the sorbent is "charged" with the sorbate and the sorption compression system is ready for operation.

As discussed above, in operation of the sorption compression system 12, the desorption cycle is initiated by activating the power supply 26 to generate a preferably DC current through the first and second conductors 20, 22 and across the sorbate/sorbent compound 24. The amount of power and the approximate length of time required to complete the desorption cycle are dependent on the amounts and types of sorbate and sorbent materials used in the sorption compression system. For example, if the system requires $X_{sorbate}$ grams of sorbate and it is known that $E_{desorb}$ joules of energy are required to desorb one gram of sorbate from the sorbent, then a total of $E_{desorb}$ joules/gram times $X_{sorbate}$ grams=$E_{total}$ joules of energy will be required to completely desorb the sorbate from the sorbent. The total desorption time, $t_{desorb}$, is obtained by dividing $E_{total}$ by the applied power level, $P_{supply}$. As the sorbate molecules are desorbed from the sorbate, the resulting high pressure sorbate will expand through the inlet/outlet port 34 and into the pressure chamber 32, where it will remain until the adsorption cycle commences.

Once the desorption cycle is complete, the system is immediately ready to commence the adsorption cycle. This is due to the fact that, although the temperature of the sorbate must be near ambient in order to effectively adsorb the sorbate molecules, as discussed above the electrical current preferably does not heat the sorbate/sorbent compound appreciably during the desorption reaction. Consequently, the sorbate remains near ambient temperature following the desorption reaction. The adsorption cycle is initiated by releasing the sorbate into the enclosure 44 of the sorber 18. Due to the affinity between the selected sorbate and sorbent molecules, the sorbate molecules will be drawn into the enclosure 44 and adsorbed onto the sorbent. The pressure of the sorbate during the adsorption reaction is substantially lower than the pressure of the sorbate following the desorption cycle and corresponds to a desired vapor pressure of the sorbate, which in turn is dependent on the temperature of the sorbate prior to adsorption and the affinity between the sorbate and sorbent molecules. Thus, a desired pressure differential for the sorbate may be achieved by selecting appropriate sorbate and sorbent materials from the vapor pressure curves for various sorbate/sorbent compounds.

A particularly advantageous feature of the present invention is the ability to cycle less than the entire amount of sorbate. Such a partial desorption can be achieved by applying the electrical current to the sorbate/sorbent compound for less than the entire amount of time required to effect a complete desorption. Since upon activation of the power supply the electrical current will immediately begin desorbing the sorbate molecules from the sorbent molecules, a proportionately larger amount of sorbate is separated from the sorbent as the desorption reaction progresses. As discussed above, the time required to desorb a given amount of sorbate with a particular power source can be readily determined. Thus, if one desires to desorb only a percentage of the available sorbate, then the current is applied for approximately the same percentage of time. Another portion or the remaining amount of sorbate may be desorbed subsequently. Alternatively, if the desorption reaction is substantially non-thermal, the desorbed portion of the sorbate may be re-adsorbed onto the sorbent. Such a partial desorption capability allows the motion of the piston 30 to be conveniently modulated and controlled by appropriately regulating the current from the power source 26.

In a preferred embodiment of the invention, the sorption compression system comprises a programmable controller 60 to manage the execution of the desorption and adsorption cycles in response to preprogrammed instructions stored in an associated memory device. Thus, the controller 60 controls the activation of the power supply 26 to initiate and terminate each desorption cycle. Over a number of desorption and adsorption cycles, a plot of the power supply current versus time would appear as a series of "pulses", with the length of each pulse corresponding to the duration of the desorption cycle and the distance between successive pulses corresponding to the duration of the adsorption cycle.

While the length of each pulse may be estimated based on the calculated duration of the desorption cycle, the sorption compression system 12 preferably includes a transducer 62 connected to the controller 60 to measure a condition of the sorbent or the sorbate/sorbent compound which is indicative of the end of the desorption cycle. For example, when the sorbent comprises a carbon based material, the current will tend to resistively heat the sorbent after the sorbate has been desorbed. Therefore, the transducer 62 could comprise a temperature sensor, which would enable the controller to monitor the temperature of the sorbate and deactivate the power supply 26 when a predetermined increase in the temperature is detected. Also, as the sorbate is desorbed from the sorbate/sorbent compound, the impedance of the sorbate/sorbent compound will decrease. Thus, the transducer 62 could comprise an impedance sensor, which would allow the controller 60 to sense the change in impedance of the sorbate/sorbent compound and deactivate the power supply 26 when a desired amount of sorbate, which may be less than the entire amount of sorbate, has been desorbed. In addition, since the maximum operating pressure of the electro-desorption actuator 10 is known, the transducer 62 could be a pressure sensor, in which case the controller 60 would deactivate the power supply 26 once the transducer detects the maximum operating pressure.

Alternatively or in addition to the transducer 62, a suitable transducer 64 could be connected to the pressure chamber 32 of the actuator housing 14 to sense a desired condition of the sorbate. For example, the pressure of the sorbate in the pressure chamber 32 is directly related to the temperature of the sorbate, the volume of the pressure chamber and the amount of sorbate within the pressure chamber. Therefore, the transducer 62 could comprise a pressure sensor, which would permit the controller 60 to monitor the pressure of the sorbate and deactivate the power supply 26 when a desired amount of sorbate has been desorbed. As a further alternative, the transducer 64 could comprises a conventional detector for sensing the position of the piston 30. In this case, the controller 60 could monitor the position of the piston 30 and activate and deactivate the power supply 26 as required to achieve a desired actuation motion.

The controller 60 also preferably actuates the valve 58 to initiate and terminate each adsorption cycle. To begin the adsorption cycle, the controller 60 generates an appropriate signal to open the valve 58. This will allow the sorbate to be drawn into the enclosure 44 and adsorbed onto the sorbent. When a desired amount of sorbate has been adsorbed, the controller 60 will close the valve 58. However, if the entire amount of sorbate within the pressure chamber 32 has been adsorbed, no need exists to close the valve 58 and it may therefore remain open. If the valve 58 has been closed at the end of the adsorption cycle, the controller 60 will open the valve at the beginning of the next desorption cycle. The length of a desired adsorption cycle can be calculated or determined empirically for a given sorber 18. Thus, upon completion of the adsorption cycle, the controller 60 may initiate the next desorption cycle, if desired, and these cycles may be repeated as necessary to operate the electro-desorption actuator 10.

It should be noted that, depending on the sorbent material selected for the sorption compression system, a valve 58 may not be necessary to control the flow of sorbate into the enclosure 44. Certain sorbent materials, such as organometallic materials, are poor electrical conductors in the absence of a sorbate. Thus, once the sorbate has been completely desorbed from the sorbent, the current will not resistively heat the sorbent. However, the small current flux through the sorbent will prohibit the sorbate molecules from re-adsorbing on the sorbent. Therefore, the power supply 26 can be activated to initiate the desorption cycle, and can be left on until the adsorption cycle is ready to commence, whereupon the power supply is deactivated.

In the sorption compression systems discussed above, the electrical conduction and minimum thermal diffusion paths coincide. However, this need not be the case. For example, a sorption compression system is shown in FIGS. 4–6 in which the electrical conduction path is perpendicular to the minimum thermal diffusion path. The sorption compression system of this embodiment, which is indicated generally by reference number 66, comprises a sorber 68 in which is positioned a sorbent 70 that is formed into a plurality of monolithic tube-shaped members 72. As shown most clearly in FIG. 6, the monolithic members 72 extend longitudinally between the first and second conductors 20, 22. Although the first and second conductors 20, 22 may be the top and bottom plates 40, 42 of the sorber 68, in this embodiment the sorber is comprised of an electrically insulating material, such as ceramic, and the first and second conductors 20, 22 comprise metallic strips which are affixed to or positioned adjacent the top and bottom plates, respectively. Thus, it may be seen that the electrical conduction path through the sorbent 70 is parallel to the longitudinal axes of the monolithic members 72. Also, the minimum thermal diffusion path through each monolithic member 72 is perpendicular to longitudinal axis of the monolithic member. Thus, the electrical conduction path through the sorbent 70 is perpendicular to the minimum thermal diffusion path through the sorbent.

The formation of the sorbent 70 into individual monolithic members 72 may be necessary, for example, to achieve a desired impedance through a particular sorbent material while minimizing the length of the thermal diffusion path through the material. In the embodiment shown in FIG. 6, the monolithic members 72 extend in a parallel fashion between the first and second conductors 20, 22. However, if desired, the monolithic members 72 may be connected in series fashion between the first and second conductors 20, 22, as shown in FIG. 7, in which event the power supply 26 would be connected between the first and last elements of the series chain of the first and second conductors 20, 22 and the monolithic members 72.

Also, although not necessary for the preferred embodiment of the invention, the sorption compression system 66 may include an ancillary cooling means to help dissipate the heat of adsorption from the sorbate/sorbent compound 70. Referring specifically to FIGS. 4 and 5, the heat of adsorption will be conducted through the sorbate/sorbent compound and into the portions of the enclosure 44 which are located between the monolithic members 72. In order to remove this heat from the enclosure 44, the sorber 68 preferably includes a first vent port 74 located at one end of the sorber, a second vent port 76 located at an opposite end of the sorber, a cooling loop 78 connected between the first and second vent ports, a pump 80 for pumping an appropriate cooling fluid through the cooling loop and the enclosure 44, and suitable valves 82, 84 disposed adjacent the first and second vent ports 74, 76, respectively, for controlling the flow of cooling fluid through the enclosure and preventing the escape of sorbate into the cooling loop during the desorption reaction. The valves are preferably solenoid-type valves which are actuated by the controller (not shown). Also, the pump 80 is ideally activated by the controller during and after the adsorption reaction, but is deactivated during the desorption reaction. Thus, during and after the desorption reaction, the cooling fluid is pumped through the enclosure 44 to remove the heat of adsorption, which in turn is dissipated in the cooling loop 78. As an alternative to the cooling means just discussed, the cooling means could simply comprise a fan or the like for blowing ambient air through the first and second vent ports 74, 76 and across the sorbate/sorbent compound 70.

Figure 8:
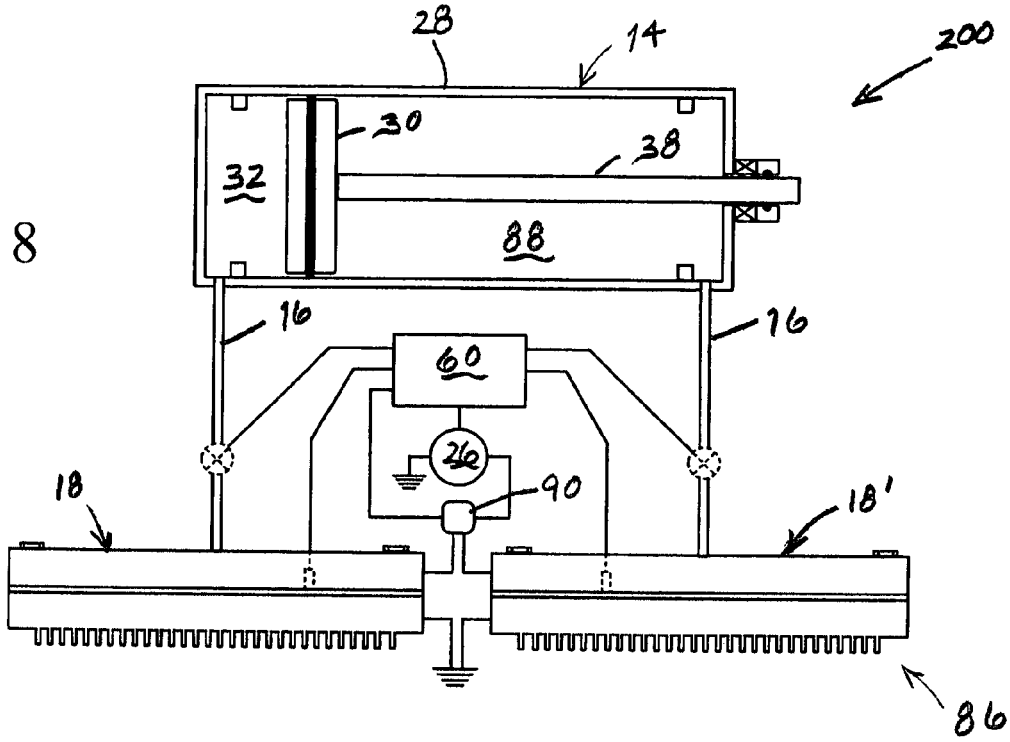
FIG. 8 is a cross-sectional view of a second embodiment of an actuator according to the present invention.

Referring now to FIG. 8, another embodiment of an electro-desorption actuator of the present invention, which is indicated generally by reference number 200, is shown to comprise a sorption compression system 86 that includes two sorbers 18, 18' which are connected to an actuator housing 14 by corresponding conduits 16. One of the conduits 16 is in communication with the pressure chamber 32, while the other conduit 16 is in communication with a sealed chamber 88 that is positioned between the cylinder 28 and the piston 30 opposite the pressure chamber 32. In addition, a switch 90 is preferably connected between the power supply 26 and a corresponding conductor of each sorber 18, 18'. The switch 90 is ideally controlled by the controller 60 to selectively connect the power supply 26 to each sorber 18, 18'.

In this embodiment of the invention, the pressure differential between the pressure chamber 32 and the sealed chamber 88 may be regulated by the controller 60 to precisely control the displacement of the piston 30 within the cylinder 28. For example, when the controller 60 initiates a desorption reaction in the sorber 18 and an adsorption reaction in the sorber 18', a relatively high pressure will be communicated to the pressure chamber 32 while a relatively negative pressure will be communicated to the sealed chamber 88, and this pressure differential will force the piston 30 to displace to the right (as viewed in FIG. 8). Similarly, when the controller initiates a desorption reaction in the sealed chamber 88 and an adsorption reaction in the pressure chamber 32, the piston will displace to the left. In addition, the controller 60 may initiate a desorption reaction in one sorber and, at a predetermined point, initiate a desorption reaction in the other sorber in order to slow or stop the displacement of the piston 30. Furthermore, since a particular pressure differential will correspond to a certain position of the piston 30 within the cylinder 28, the controller 60 may actuate the sorbers 18, 18' as necessary to index the piston between a plurality of predetermined positions.

In a variation of the embodiment of the invention of FIG. 8 which is not shown in the drawings, both of the conduits 16 may be connected to the pressure chamber 32. The sorbers 18, 18' may then be activated either simultaneously or sequentially to displace the piston 30 within the cylinder 28. Simultaneous operation of the sorbers 18, 18' may be appropriate, for example, when it is desired to displace the piston 30 relatively quickly or with a relatively constant force over its entire length of travel. Sequential operation of the sorbers 18, 18' may be desired, for example, when a need exists to reciprocate the piston 30 relatively quickly. This may be accomplished by initiating an adsorption cycle in one sorber as soon as a desorption cycle is completed in the other sorber. Moreover, this sequential operation of the sorbers 18, 18' will provide a period of time after each adsorption cycle during which the heat of adsorption is allowed to dissipate from the sorbate/sorbent compound.

Figure 9:
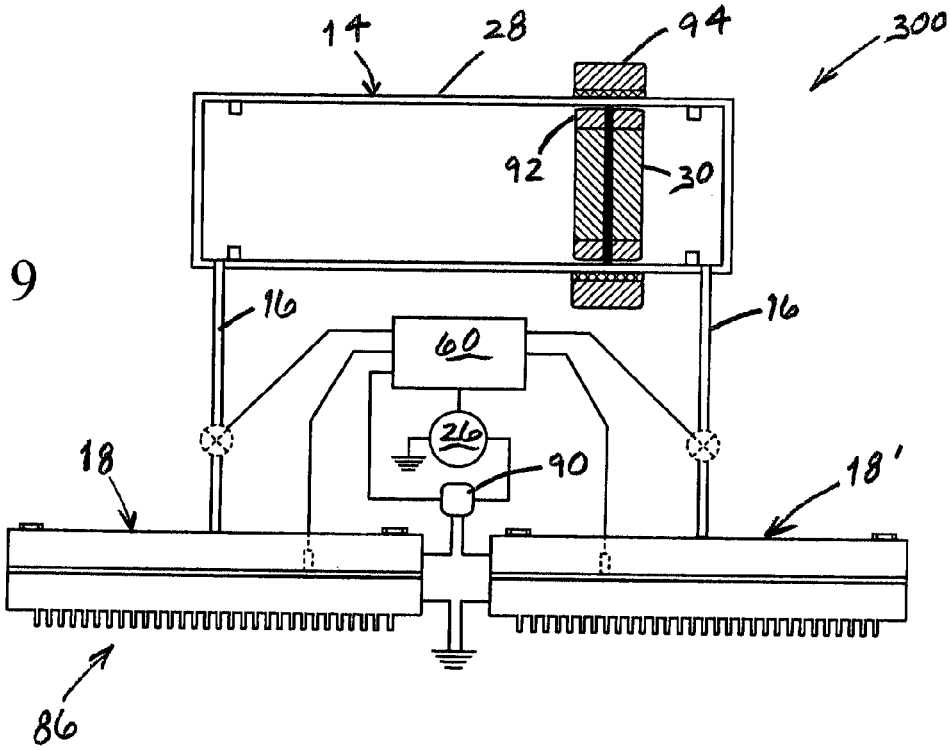
FIG. 9 is a cross-sectional view of a third embodiment of an actuator according to the present invention.

Another embodiment of an electro-desorption actuator of the present invention is illustrated in FIG. 9. The electro-desorption actuator of this embodiment, which is indicated generally by reference number 300, is similar in many respects to the electro-desorption actuator of FIG. 8. However, in this embodiment the piston 30 is not connected to a pusher rod. Rather, the piston comprises a magnetic ring 92 which is magnetically coupled to an actuator ring 94 that is slidably supported on the cylinder 28. Thus, movement of the piston 30 within the cylinder 28 will cause the actuator ring 94 to move accordingly. The cylinder 28 may therefore be entirely sealed, which will reduce the risk that sorbate from the sorbers 18, 18' will escape from the actuator housing 14.

Referring now to FIG. 10, another embodiment of an electro-desorption actuator of the present invention, which is indicated generally by reference number 400, is shown to comprise a sorption compression system 96 which includes a sorber 18 that is disposed within or forms a part of the cylinder 28 of the actuator housing 14. The sorber 18 includes an inlet/outlet port 34 which communicates directly with a pressure chamber 32 that is formed between the sorber and the piston 30. Electrical current from a power supply (not shown) is communicated to the first and second conductors of the sorber 18 via suitable leads 98*a*, 98*b*. In the event the cylinder 28 is made from an electrically conducting material, the sorption compression system 96 preferably includes suitable insulator means (not shown) to electrically isolate the first and second conductors from the cylinder. Thus, the electro-desorption actuator 400 does not comprise any independent conduits between the sorber 18 and the pressure chamber 32 which could leak and thereby cause the actuator to fail. It should be understood that the sorber.

In a variation of the embodiment of the invention of FIG. 10 which is not shown in the drawings, the piston 30 is not connected to a pusher rod. Rather, similar to the embodiment of the invention illustrated in FIG. 9, the piston 30 comprises a magnetic ring which is magnetically coupled to an actuator ring that is slidably supported on the cylinder 28. Thus, the cylinder 28 may be entirely sealed to prevent the leakage of high pressure sorbate from the actuator housing 14.

In accordance with the present invention, the electro-desorption actuator could comprise any of a variety of fixed and movable members. For example, referring to FIG. 11, an embodiment of an electro-desorption actuator, generally 500, is shown to comprise a generally flat fixed member 100 which is coupled to a generally flat movable member 102 by a flexible bladder 104. The bladder 104, which defines the pressure chamber between the fixed and movable members, is connected to a sorption compression system (not shown) by a suitable conduit 16. Accordingly, when the sorbate is desorbed in to the bladder 104, the bladder will expand and displace the movable member 102 away from the fixed member 100. Similarly, when the sorbate is re-adsorbed onto the sorbent, the bladder 104 will contract and pull the movable member 102 toward the fixed member 100.

Referring to FIG. 12, an embodiment of an electro-desorption actuator, generally 600, is shown to comprise a fixed member 106 which is hingedly connected to a movable member 108, and a flexible bladder 110 which is connected between the fixed and movable members. As in the previous embodiment, the flexible bladder 110 comprises the pressure chamber between the fixed and movable members and is connected to a sorption compression system (not shown) by a conduit 16. When the sorbate is desorbed into the bladder 110, the bladder will expand and pivot the movable member 108 clockwise relative to the fixed member 106 (as viewed in FIG. 12). Similarly, when the sorbate is re-adsorbed onto the sorbent, the bladder 110 will contract and pivot the movable member 108 counterclockwise relative to the fixed member 106. The bladder 110 could also be constructed such that, when it is inflated, the length of the bladder between the points where the bladder is connected to the fixed and movable members will contract and thereby pivot the movable member counterclockwise relative to the fixed member.

It should be recognized that, while the present invention has been described in relation to the preferred embodiments thereof, those skilled in the art may develop a wide variation of structural and operational details without departing from the principles of the invention. For example, the various elements shown in the different embodiments may be combined in a manner not illustrated above. Therefore, the appended claims are to be construed to cover all equivalents falling within the true scope and spirit of the invention.

We claim:

1. An electro-desorption actuator which comprises:

a fixed member;

a movable member which is coupled to the fixed member;

a pressure chamber which is disposed between the fixed member and the movable member; and a sorption compression system which is in communication with the pressure chamber and which comprises:

first and second electrical conductors;

a sorbent which is positioned between the first and second conductors;

a sorbate which is capable of combining with the sorbent in an adsorption reaction to form a sorbate/sorbent compound; and a power supply which is connected to the conductors and which is selectively actuated to generate a current that is conducted through the sorbate/sorbent compound to desorb the sorbate from the sorbent in a desorption reaction;

wherein the sorbate is communicated from the sorption compression system to the pressure chamber during the desorption reaction and from the pressure chamber back to the sorption compression system during the adsorption reaction;

whereby during the desorption reaction a relatively high pressure is created in the pressure chamber which will displace the movable member in one direction, and during the adsorption reaction a relatively low pressure is created in the pressure chamber which will displace the movable member in the opposite direction.

2. The electro-desorption actuator of claim 1, wherein the desorption reaction is substantially non-thermal.

3. The electro-desorption actuator of claim 1, further comprising a controller for selectively activating the power supply to initiate and terminate each desorption reaction.

4. The electro-desorption actuator of claim 3, further comprising at least one valve for controlling the flow of sorbate between the sorption compression system and the pressure chamber.

5. The electro-desorption actuator of claim 4, wherein the valve is actuated by the controller.

6. The electro-desorption actuator of claim 1, wherein the first and second conductors form an enclosure for the sorbate/sorbent compound which is in communication with the pressure chamber.

7. The electro-desorption actuator of claim 6, wherein:

the sorbent comprises first and second spaced-apart, generally parallel surfaces and a thickness which is transverse to the first and second surfaces; and the thickness is less than one-half a smallest linear dimension of the surfaces.

8. The electro-desorption actuator of claim 6, wherein the sorbent is attached to at least one of the first and second conductors.

9. The electro-desorption actuator of claim 1, further comprising:

an enclosure which is in communication with the pressure chamber and within which the sorbate/sorbent compound is disposed;

wherein the first and second conductors are positioned within the enclosure.

10. The electro-desorption actuator of claim 9, wherein the sorbent comprises a plurality of elongated monoliths which extend between the first and second conductors.

11. The electro-desorption actuator of claim 1, wherein the sorbate/sorbent compound comprises an impedance which is approximately the same as the impedance of the power supply.

12. The electro-desorption actuator of claim 1, wherein the sorbent comprises a graphitic foam material.

13. The electro-desorption actuator of claim 1, wherein the fixed member comprises a cylinder and the movable member comprises a piston which is slidably disposed within the cylinder.

14. The electro-desorption actuator of claim 13, wherein the sorption compression system comprises an enclosure within which the sorbent is positioned and the enclosure is disposed within the cylinder adjacent the pressure chamber.

15. The electro-desorption actuator of claim 13, wherein the piston is connected to a pusher rod to which an external device is connectable.

16. The electro-desorption actuator of claim 13, wherein the piston comprises a first ring which is magnetically coupled to a second ring that is slidably supported on the cylinder.

17. The electro-desorption actuator of claim 1, further comprising a flexible bladder which is connected between the fixed member and the movable member, wherein the pressure chamber comprises the flexible bladder.

18. The electro-desorption actuator of claim 17, wherein the fixed member is hingedly connected to the movable member.

19. The electro-desorption actuator of claim 1, wherein the sorption compression system comprises an enclosure which includes the first and second electrical conductors and the sorbent.

20. The electro-desorption actuator of claim 19, wherein the sorption compression system comprises at least two enclosures, each of which includes a pair of first and second electrical conductors and a sorbent.

21. The electro-desorption actuator of claim 20, wherein the enclosures are in communication with the pressure chamber.

22. The electro-desorption actuator of claim 20, wherein one of the enclosures is in communication with the pressure chamber and another of the enclosures is in communication with a sealed chamber which is disposed between the fixed member and the movable member opposite the pressure chamber.

23. A electro-desorption actuator which comprises:

a first member;

a second member;

a first chamber which is disposed between the first and second members;

a sorption compression system which comprises:

an enclosure which is in communication with the first chamber and which includes first and second spaced-apart electrical conductors;

a sorbent which is positioned within the enclosure between the first and second conductors;

a sorbate which is capable of combining with the sorbent in an adsorption reaction to form a sorbate/sorbent compound; and a power supply which is connected to the first and second conductors and which generates an electrical current that is conducted through the sorbate/sorbent compound to desorb the sorbate from the sorbent in a desorption reaction;

wherein the sorbate is communicated from the enclosure to the first chamber during the desorption reaction and from the first chamber back to the enclosure during the adsorption reaction;

whereby during the desorption reaction a relatively high pressure is created in the first chamber which will displace the second member relative to the first member in one direction, and during the adsorption reaction a relatively low pressure is created in the first chamber which will displace the second member relative to the first member in the opposite direction.

24. The electro-desorption actuator of claim 23, wherein the desorption reaction is substantially non-thermal.

25. The electro-desorption actuator of claim 23, further comprising a controller for selectively activating the power supply to initiate and terminate each desorption reaction.

26. The electro-desorption actuator of claim 25, further comprising at least one valve for controlling the flow of sorbate between the enclosure and the first pressure chamber.

27. The electro-desorption actuator of claim 26, wherein the valve is actuated by the controller.

28. The electro-desorption actuator of claim 23, wherein:

the sorbent comprises first and second spaced-apart, generally parallel surfaces and a thickness which is transverse to the first and second surfaces; and the thickness is less than one-half a smallest linear dimension of the surfaces.

29. The electro-desorption actuator of claim 28, wherein the sorbent is attached to at least one of the first and second conductors.

30. The electro-desorption actuator of claim 23, wherein the sorbent comprises a plurality of elongated monoliths which extend between the first and second conductors.

31. The electro-desorption actuator of claim 23, wherein the sorbate/sorbent compound comprises an impedance which is approximately the same as the impedance of the power supply.

32. The electro-desorption actuator of claim 23, wherein the sorbent comprises a graphitic foam material.

33. The electro-desorption actuator of claim 23, wherein the first member comprises a cylinder and the second member comprises a piston which is slidably disposed within the cylinder.

34. The electro-desorption actuator of claim 33, wherein the enclosure is disposed within the cylinder adjacent the pressure chamber.

35. The electro-desorption actuator of claim 33, wherein the piston is connected to a pusher rod to which an external device is connectable.

36. The electro-desorption actuator of claim 33, wherein the piston comprises a first ring which is magnetically coupled to a second ring that is slidably supported on the cylinder.

37. The electro-desorption actuator of claim 23, further comprising a flexible bladder which is connected between the first member and the second member, wherein the pressure chamber comprises the flexible bladder.

38. The electro-desorption actuator of claim 37, wherein the fixed member is hingedly connected to the movable member.

39. The electro-desorption actuator of claim 23, wherein the sorption compression system comprises at least two enclosures, each of which includes a pair of first and second electrical conductors and a sorbent.

40. The electro-desorption actuator of claim 39, wherein the enclosures are in communication with the first chamber.

41. The electro-desorption actuator of claim 39, wherein one of the enclosures is in communication with the first chamber and another of the enclosures is in communication with a second chamber which is disposed between the first and second members opposite the first chamber.

42. A method of displacing a first member relative to a second member which comprises:

positioning a pressure chamber between the first and second members;

communicating the pressure chamber with a sorbent;

adsorbing a sorbate onto the sorbent in an adsorption reaction to form a sorbate/sorbent compound; and generating a current through the sorbate/sorbent compound to desorb the sorbate from the sorbent in a desorption reaction;

wherein the sorbate is communicated from the sorbent to the pressure chamber during the desorption reaction and from the pressure chamber back to the sorbent during the adsorption reaction;

whereby during the desorption reaction a relatively high pressure is created in the pressure chamber which will displace the first member relative to the second member.

* * * * *